US006423163B2

(12) United States Patent
Smolej et al.

(10) Patent No.: US 6,423,163 B2
(45) Date of Patent: Jul. 23, 2002

(54) PROCESS FOR THE MANUFACTURE OF A FREE-CUTTING ALUMINUM ALLOY

(75) Inventors: Anton Smolej, Ljubljana; Vukašin Dragojevič , Zgornja Polskava; Edvard Slaček, Slovenska Bistrica; Tomaž Smolar, Zgornja Polskava, all of (SI)

(73) Assignee: Impol Aluminum Corporation, New Rochelle, NY (US)

( * ) Notice: Subject to any disclaimer, the term of this patent is extended or adjusted under 35 U.S.C. 154(b) by 0 days.

(21) Appl. No.: 09/847,561

(22) Filed: May 1, 2001

Related U.S. Application Data

(62) Division of application No. 09/323,522, filed on Jun. 1, 1999, now Pat. No. 6,248,188.

(30) Foreign Application Priority Data

Dec. 22, 1998 (SI) ..... 9800316

(51) Int. Cl.[7] ..... C22C 21/12
(52) U.S. Cl. ..... 148/550; 148/551; 148/690
(58) Field of Search ..... 148/550, 551, 148/690

(56) References Cited

U.S. PATENT DOCUMENTS 6,248,188 B1 * 6/2001 Smolej et al. ..... 148/417

FOREIGN PATENT DOCUMENTS

| | | |
|---|---|---|
| EP | 0964070 | 12/1999 |
| JP | 6274044 | 4/1987 |
| JP | 7097653 | 4/1995 |

* cited by examiner

*Primary Examiner*—George Wyszomierski
(74) *Attorney, Agent, or Firm*—Webb Ziesenheim Logsdon Orkin & Hanson, P.C.

(57) ABSTRACT

A free-cutting aluminum alloy without lead as an alloy element, containing: (a) as alloy elements: 0.5 to 1.0 wt. % Mn; 0.4 to 1.8 wt. % Mg; 3.3 to 4.6 wt. % Cu; 0.4 to 1.9 wt. % Sn; 0 to 0.1 wt. % Cr; 0 to 0.2 wt. % Ti; (b) as impurities: up to 0.8 wt. % Si; up to 0.7 wt. % Fe; up to 0.8 wt. % Zn; up to 0.1 wt. % Pb; up to 0.1 wt. % Bi; up to 0.3 wt. % total of other impurities; and (c) the balance being substantially aluminum. The process includes the steps of semicontinuously casting the above alloy composition followed by homogenization annealing, cooling, heating to a working temperature for extrusion, extruding at a maximum temperature of 380° C., followed by press-quenching and aging. The aging may be a natural aging or an artificial aging. A cold working step and/or a tension straightening step also may be conducted after the press-quenching step. The extruding step includes indirectly extruding.

10 Claims, No Drawings

PROCESS FOR THE MANUFACTURE OF A FREE-CUTTING ALUMINUM ALLOY

CROSS-REFERENCE TO RELATED APPLICATION

This application is a divisional of application Ser. No. 09/323,522, filed Jun. 1, 1999 now U.S. Pat. No. 6,248,188, which claims priority to Slovenian Patent Application No. 9800316, filed Dec. 22, 1998.

TECHNICAL FIELD

The present invention relates to a novel free-cutting aluminum alloy which does not contain lead as an alloying element but only as a possible impurity. The invention further relates to processes for the production of such alloy and to the use thereof. The alloy exhibits superior strength properties, superior workability, superior free-cutting machinability, corrosion resistance, requires less energy consumption and is environmentally friendly in production and use. The present alloy is preferably intended to replace free-cutting alloys of the group AlCuMgPb (AA2030).

BACKGROUND OF THE INVENTION

Free-cutting aluminum alloys were developed from standard heat treatable alloys, to which additional elements for forming softer phases in the matrix were added. These phases improve the machinability of the material during cutting by obtaining a smooth surface, while requiring decreased cutting forces and providing decreased tool wear. Chip breakage is also especially improved.

These softer phases are formed by alloying elements that are not soluble in aluminum, do not form intermetallic compounds with aluminum and have low melting points. Elements with these properties are lead, bismuth, tin, cadmium, indium and some others, which are not applicable for practical reasons. Said elements added individually or in combinations are precipitated during solidification in the form of globulite inclusions having a particle size from a few $\mu$ms to some tens of $\mu$ms.

The most important free-cutting aluminum alloys are:

Al—Cu with 0.2–0.6 wt. % Pb and 0.2–0.6 wt. % Bi (AA2011);

Al—Cu—Mg with 0.8–1.5 wt. % Pb and up to 0.2 wt. % Bi (AA2030); and

Al—Mg—Si with 0.4–0.7 wt. % Pb and 0.4–0.7 wt. % Bi (AA6262).

In these alloys, inclusions are formed for the purpose of easier machinability, especially through the use of lead and bismuth. Recently, there has been a tendency to replace lead with other elements because of risks to human health and for ecological reasons. As substitutes, tin and partly indium are most frequently used. The possibility of using tin in aluminum free-cutting alloys has been well-known for a long time. Tin was one of the first elements to be added to aluminum free-cutting alloys in amounts up to 2 wt. %. In practice, the use thereof, on a larger scale, has never taken place because of an alleged impairment of corrosion properties, poorer alloy ductility and high price. Recently, tin has been added, especially to alloys of the groups Al—Mg—Si (AA6xxx series) and Al—Cu (AA2xxx series) containing—when in standard form—lead and bismuth, or lead only.

Alloys with tin should have similar or better properties as to microstructure, workability, mechanical properties, corrosion resistance and machinability in comparison with standard alloys. The formation of suitable chips of alloys with tin depends—similarly as in alloys with lead and bismuth—on the effect of inclusions for easier cutting upon the mechanism of breaking the material during cutting.

Earlier investigations and explanations of the mechanism of breaking chips have been based particularly on alloys containing lead and bismuth. Both elements form softer phases in a harder basis and retain their chemical and metallographic characteristics. At discontinuity sites, cohesion forces are weaker and, thus, the desirable breaking of chips during machining is facilitated. The distribution of globulite phases should be fine and uniform. A simultaneous addition of smaller amounts of two or more elements insoluble in aluminum has a greater effect upon machinability than the addition of one element. The elements are present in globulite phases in ratios equaling the analytical averages thereof.

It is known on the basis of practical experience that the breaking of chips is best at an eutectic composition of the elements insoluble in aluminum. Thus, the opinion prevails that a suitable breaking of chips is a result of the melting of said inclusions at temperatures attained during the working of the material by turning, boring, etc.

SUMMARY OF THE INVENTION

The present invention relates to novel free-cutting aluminum alloys that do not contain lead as an alloy element and further relates to processes for the production of these alloys and to the use thereof. The present alloy possesses superior strength properties, superior workability, superior machinability, corrosion resistance, requires less energy consumption and is environmentally friendly in production and use.

These improved properties and a lowering of the production costs are attained by means of an optimum selection of alloying elements, working processes and thermomechanical treatments.

The present invention provides a free-cutting aluminum alloy containing:

a) as alloy elements:
- 0.5 to 1.0 wt. % Mn,
- 0.4 to 1.8 wt. % Mg,
- 3.3 to 4.6 wt. % Cu,
- 0.4 to 1.9 wt. % Sn,
- 0 to 0.1 wt. % Cr,
- 0 to 0.2 wt. % Ti, b) as impurities:
- up to 0.8 wt. % Si,
- up to 0.7 wt. % Fe,
- up to 0.8 wt. % Zn,
- up to 0.1 wt. % Pb,
- up to 0.1 wt. % Bi,
- up to 0.3 wt. % total of all remaining impurities, and c) the balance substantially 100% aluminum.

The alloy containing 1.1 to 1.5 wt. % Sn is preferable.

The alloy containing up to 0.06 wt. % Pb is preferable.

The alloy containing up to 0.05 wt. % Bi is preferable.

The invention further provides a process for working and thermal treatment of the above alloy by semicontinuous casting, homogenization annealing, cooling from the homogenization annealing temperature, heating to the working temperature of extrusion, comprising novel and inventive process measures of carrying out an indirect extrusion at the maximum temperature of 380° C., press-quenching and natural aging.

According to a variant of the above process, the indirect extrusion step is conducted at a maximum temperature of 380° C., press-quenching and artificial aging are conducted at a temperature of from 130 to 190° C. for 8 to 12 hours.

According to a further variant of the above process, the indirect extrusion is conducted at a maximum temperature of 380° C., followed by press-quenching, cold working and natural aging.

According to a further variant of the above process, the indirect extrusion is conducted at a maximum temperature of 380° C., followed by press-quenching, cold working and artificial aging at a temperature from 130 to 190° C. for 8 to 12 hours.

According to a further variant of the above process, the indirect extrusion is conducted at a maximum temperature of 380° C., followed by press-quenching, tension straightening and natural aging.

According to a further variant of the above process, the indirect extrusion step is conducted at a maximum temperature of 380° C., followed by press-quenching, tension straightening and artificial aging at a temperature from 130 to 190° C. for 8 to 12 hours.

According to a further variant of the above process, the indirect extrusion step is conducted at a maximum temperature of 380° C., followed by press-quenching, cold working, tension straightening and natural aging.

According to a further variant of the above process, the indirect extrusion is conducted at the maximum temperature of 380° C., followed by press-quenching, cold working, tension straightening and artificial aging are conducted at a temperature from 130 to 190° C. for 8 to 12 hours.

A further object of the invention is a product obtained according to the above process or variants thereof, having a tensile strength of 293 to 487 N/mm$^2$, a yield stress of 211 to 464 N/mm$^2$, a hardness HB of 73 to 138 and an elongation at failure of 4.5 to 13%.

A further object of the invention is a product obtained according to the above process or variants thereof, having a tensile strength of 291 to 532 N/mm$^2$, a yield stress of 230 to 520 N/mm$^2$, a hardness HB of 73 to 141 and an elongation at failure of 5.5 to 11.5%.

DETAILED DESCRIPTION OF THE INVENTION

Alloys made according to the present invention are divided into five groups with respect to their tin content.

1$^{st}$ group: 0.40 wt. % Sn to 0.70 wt. % Sn

2$^{nd}$ group: 0.71 wt. % Sn to 1.00 wt. % Sn

3$^{rd}$ group: 1.01 wt. % Sn to 1.30 wt. % Sn

4$^{th}$ group: 1.31 wt. % Sn to 1.60 wt. % Sn

5$^{th}$ group: 1.61 wt. % Sn to 1.90 wt. % Sn

Alloys have to be divided with respect to their tin content because an increasing tin content at a constant content of other alloying elements and impurities causes a reduction of strength properties after thermal treatment. On the other hand, an increasing tin content results in the formation of more favorable chips during machining.

At a constant content of alloying elements and impurities and under the same conditions of casting, homogenization annealing, working with extrusion and thermal treatment, the mechanical properties and machinability of semi-finished products from alloys depend upon the tin content. An increasing tin content improves machinability with respect to an easier chip breaking. A higher tin content results in smaller chips. An increasing tin content causes a lower tensile strength and yield stress.

Cutting conditions affect the machinability of alloys containing tin. At higher cutting rates with tools made of carbide hard metal alloys, also at lower tin contents (<1.2 wt. % Sn), favorable chips are obtained.

Alloys with lower tin contents have poorer chips at lower cutting rates and good chips at higher cutting rates. Alloys with lower tin contents have higher mechanical properties in comparison with alloys having higher tin contents.

Alloys with higher tin contents have favorable chips at all cutting rates. Alloys with higher tin contents have lower mechanical properties in comparison with alloys with lower tin contents.

The tin content limit affecting the obtaining of favorable or unfavorable chips as well as higher or lower mechanical properties is 1.2 wt. % Sn.

The invention comprises novel processes for the working and thermal treatment of the above aluminum alloys with tin. Semi-finished products made of standard free-cutting alloys of the group AlCuMgPb in the form of rods having a circular or hexagonal cross section are usually manufactured according to the following processes:

Process 1 (T3).

Semicontinuous casting, homogenization annealing, cooling from the homogenization annealing temperature, heating to the working temperature of extrusion, extrusion, solution annealing (usually in a salt bath for alloys of the group AA2xxx), quenching, cold deformation with drawing, natural aging.

Process 2 (T4).

Semicontinuous casting, homogenization annealing, cooling from the homogenization annealing temperature, heating to the working temperature of extrusion, extrusion, solution annealing (usually in a salt bath for alloys of the group AA2xxx), quenching, natural aging.

Process 3 (T6).

Semicontinuous casting, homogenization annealing, cooling from the homogenization annealing temperature, heating to the working temperature of extrusion, extrusion, solution annealing (usually in a salt bath for alloys of the group AA2xxx), quenching, artificial aging.

Process 4 (T8).

Semicontinuous casting, homogenization annealing, cooling from the homogenization annealing temperature, heating to the working temperature of extrusion, extrusion, solution annealing (usually in a salt bath for alloys of the group AA2xxx), quenching, cold deformation with drawing, artificial aging.

Novel processes for the manufacture, working and thermomechanical treatment of the inventive alloy of the group AlCuMg with Sn relate to (1) a change of working temperatures, which are higher than in conventional processes, (2) introduction of indirect extrusion with higher extrusion rates, (3) press-quenching directly after the extruded piece exits the die, (4) increased degrees of cold deformation during thermomechanical treatment, (5) optimum temperatures and time periods of artificial aging, and (6) processes for achieving a stress-free state in extruded and thermomechanically treated rods.

The introduction of novel processes for working and thermomechanical treatment of alloys is advantageous over conventional processes for the following reasons:

By various combinations of technological processes after the extrusion of the alloy, it is possible to achieve various controlled mechanical properties of semi-finished products and technological properties such as improved machinability and surface quality.

The inventive technological processes for working and thermomechanical treatment show the following advantages in comparison with semi-finished products made using standard alloys of the group AlCuMgPb according to the conventional processes:

Quicker extrusion of the material in the indirect extrusion press.

By press-quenching, the working heat is utilized for solution annealing. According to this process, separate solution annealing, usually taking place in salt baths, may be omitted. Thus, less energy and working times are required. It will also be appreciated that in this way, ecological problems in connection with the use of a salt for solution annealing are also solved. (Alloys of the group AA2xxx, in which the conventional alloy AlCuMgPb (AA2030) belongs, are prepared according to a process of separate solution annealing.)

Due to the use of press-quenching, the alloys have a smooth and light surface. In conventional processes with separate solution annealing, a darker surface is formed because of the oxidation of magnesium on the rod surface, the effect of salt corrosion. Mechanical damage to the extruded rod surfaces caused by manipulating in several handling operations required in conventional processing is eliminated by the process of the present invention.

By combining cold deformation and the degree of the cold deformation before natural or artificial aging, strength properties increased. Mechanical properties (yield stress, tensile strength) of the inventive alloys with tin are lower than those of the conventional alloy AlCuMgPb (AA2030).

By combining cold deformation before natural or artificial aging, internal stresses are minimized.

By introducing deformation before the aging of extruded rods, a stress-free state in semi-finished products is achieved.

The invention also comprises the following processes in the manufacture and thermal treatment of the novel alloy with tin:

Process a.

Process a. comprises the following steps:

Semicontinuous casting of bars; homogenization annealing of the semicontinuously cast bars for eight hours at 490° C.; cooling the bars after homogenization to ambient temperature with a cooling rate of 230° C./h; heating the bars to a working temperature of 380° C.; and indirect extrusion of the bars or billets into rods with diameters from 12 mm to 127 mm followed by quenching of the extruded rods. The invention also comprises cooling the extrusion tool—the die—with liquid nitrogen. The die must be cooled because of the high working temperatures necessary for a successful solution annealing at the extrusion press. The quenching of the extruded pieces after leaving the die takes place in a water wave. The maximum permissible time between the working and the quenching of the material is 30 seconds. The maximum permissible cooling of the surface of the extruded pieces before quenching is 10° C. Natural aging of the quenched, extruded pieces takes six days.

Process b.

Process b. comprises the following steps:

Semicontinuous casting of bars; homogenization annealing of the semicontinuously cast bars for eight hours at 490° C.; cooling the bars after homogenization to ambient temperature with a cooling rate of 230° C./h; heating the bars to a working temperature of 380° C.; and indirectly extruding the bars or billets into rods with diameters from 12 mm to 127 mm. The invention also comprises cooling the extrusion tool—the die—with liquid nitrogen. The die must be cooled because of the high working temperatures necessary for a successful solution annealing at the extrusion press. The quenching of extruded pieces after leaving the die takes place in a water wave. The maximum permissible time between the working and the quenching of the material is 30 seconds. The maximum permissible cooling of the surface of the extruded pieces before quenching is 10° C. Artificial aging is conducted for 8 to 12 hours within a temperature range from 130 to 190° C.

Process c.

Process c. comprises the following steps:

Semicontinuous casting of bars; homogenization annealing of the semicontinuously cast bars for eight hours at 490° C.; cooling the bars after homogenization to ambient temperature with a cooling rate of 230° C./h; heating the bars to a working temperature of 380° C.; and indirectly extruding the bars or billets into rods with diameters from 12 mm to 127 mm. The invention also comprises cooling the extrusion tool—the die—with liquid nitrogen. The die must be cooled because of the high working temperatures necessary for a successful solution annealing at the extrusion press. The quenching of extruded pieces after leaving the die takes place in a water wave. The maximum permissible time between the working and the quenching of the material is 30 seconds. The maximum permissible cooling of the surface of the extruded pieces before quenching is 10° C. Extruded and quenched rods are then drawn with a deformation rate of up to 15%. Natural aging of the drawn rods takes six days.

Process d.

Process d. comprises the following steps:

Semicontinuous casting of bars; homogenization annealing of the semicontinuously cast bars for eight hours at 490° C.; cooling the bars after homogenization to ambient temperature with a cooling rate of 230° C./h; heating the bars to a working temperature of 380° C.; and indirectly extruding the bars or billets into rods with diameters from 12 mm to 127 mm. The invention also comprises cooling the extrusion tool—the die—with liquid nitrogen. The die must be cooled because of the high working temperatures necessary for a successful solution annealing at the extrusion press. The quenching of extruded pieces after leaving the die takes place in a water wave. The maximum permissible time between the working and the quenching of the material is 30 seconds. The maximum permissible cooling of the surface of the extruded pieces before quenching is 10° C. Process d. also includes drawing the extruded and quenched rods with a deformation rate of up to 15%. Artificial aging for 8 to 12 hours is conducted within a temperature range from 130 to 190° C. The final technological phase is a process for obtaining a stress-free state of semi-finished products in the form of rods.

The present novel alloys may also be thermally and thermomechanically treated according to processes of separate solution annealing, which correspond to processes according to the classification of Aluminum Association T3, T4, T6 and T8 (these processes marked by e, f, g and h in Table 1 are not objects of the present invention).

Process i.

Process i. comprises the following steps:

Semicontinuous casting of bars; homogenization annealing of semicontinuously cast bars for eight hours at 490° C.; cooling the bars after homogenization to ambient temperature with a cooling rate of 230° C./h; heating the bars to a working temperature of 380° C.; and indirectly extruding the bars or billets into rods with diameters from 12 mm to 127 mm. The invention also comprises the cooling of the extrusion tool—the die—with liquid nitrogen. The die must be cooled because of the high working temperatures necessary for a successful solution annealing at the extrusion press. The quenching of extruded pieces after leaving the die takes place in a water wave. The maximum permissible time between the working and the quenching of the material is 30 seconds. The maximum permissible cooling of the surface of the extruded pieces before quenching is 10° C. Process i. further includes tension straightening of extruded pieces in order to obtain a stress-free state followed by natural aging for six days.

Process j.

Process j. comprises the following steps:

Semicontinuous casting of bars; homogenization annealing of the semicontinuously cast bars for eight hours at 490° C.; cooling the bars after homogenization to ambient temperature; heating the bars to a working temperature of 380° C.; and indirectly extruding the bars or billets into rods with diameters from 12 mm to 127 mm. The invention also comprises the cooling of the extrusion tool—the die—with liquid nitrogen. The die must be cooled because of the high working temperatures necessary for a successful solution annealing at the extrusion press. The quenching of extruded pieces after leaving the die takes place in a water wave. The maximum permissible time between the working and the quenching of the material is 30 seconds. The maximum permissible cooling of the surface of the extruded pieces before quenching is 10° C. Process j. also include tension straightening of the extruded pieces in order to obtain a stress-free state followed by artificial aging for 8 to 12 hours in a temperature range from 130 to 190° C.

Process k.

Process k. comprises the following steps:

Semicontinuous casting of bars; homogenization annealing of the semicontinuously cast bars for eight hours at 490° C.; cooling the bars after homogenization to ambient temperature with a cooling rate of 230° C./h; heating the bars to a working temperature of 380° C.; and indirectly extruding the bars or billets into rods with diameters from 12 mm to 127 mm. The invention also comprises the cooling of the extrusion tool—the die—with liquid nitrogen. The die must be cooled because of the high working temperatures necessary for a successful solution annealing at the extrusion press. The quenching of extruded pieces after leaving the die takes place in a water wave. The maximum permissible time between the working and the quenching of the material is 30 seconds. The maximum permissible cooling of the surface of the extruded pieces before quenching is 10° C. Extruded and quenched rods are drawn according to Process k. with a deformation rate of up to 15% followed by tension straightening of the extruded pieces in order to obtain a stress-free state, followed by natural aging for six days.

Process l.

Process l. comprises the following steps:

Semicontinuous casting of bars; homogenization annealing of the semicontinuously cast bars for eight hours at 490° C.; cooling the bars after homogenization to ambient temperature; heating the bars to a working temperature of 380° C.; and indirectly extruding the bars or billets into rods with diameters from 12 mm to 127 mm. The invention also comprises the cooling of the extrusion tool—the die—with liquid nitrogen. The die must be cooled because of the high working temperatures necessary for a successful solution annealing at the extrusion press. The quenching of extruded pieces after leaving the die takes place in a water wave. The maximum permissible time between the working and the quenching of the material is 30 seconds. The maximum permissible cooling of the surface of the extruded pieces before quenching is 10° C. Extruded and quenched rods are drawn according to Process l. with a deformation rate of up to 15%, followed by tension straightening of the extruded pieces in order to obtain a stress-free state, followed by artificial aging for 8 to 12 hours in a temperature range from 130 to 190° C.

TABLE 1

Kinds of technologies for the manufacture and thermal treatment of free-cutting alloys of the group AlCuMgSn with main technological phases

| Process marked | Extrusion/ temp (° C.) | Kind of quenching | Working | Aging/ temperature (° C.)/time (h) |
|---|---|---|---|---|
| a | extrusion/ 380 | press-quenching | | natural aging |
| b | extrusion/ 380 | press-quenching | | artificial aging/ 130–190/8–12 |
| c | extrusion/ 380 | press-quenching | cold | natural aging |
| d | extrusion/ 380 | press-quenching | cold | artificial aging/ 130–190/8–12 |
| e* | extrusion/ 350 | salt bath | | natural aging |
| f* | extrusion/ 350 | salt bath | | artificial aging/ 130–190/8–12 |
| g* | extrusion/ 350 | salt bath | cold | natural aging |
| h* | extrusion/ 350 | salt bath | cold | artificial aging/ 130–190/8–12 |

TABLE 1-continued

Kinds of technologies for the manufacture and thermal treatment of free-cutting alloys of the group AlCuMgSn with main technological phases

| Process marked | Extrusion/ temp (° C.) | Kind of quenching | Working | Aging/ temperature (° C.)/time (h) |
|---|---|---|---|---|
| i | extrusion/ 380 | press-quenching | tension straightened | natural aging |
| j | extrusion/ 380 | press-quenching | tension straightened | artificial aging/ 130–190/8–12 |
| k | extrusion/ 380 | press-quenching | cold and straightened | natural aging |
| l | extrusion/ 380 | press-quenching | cold and straightened | artificial aging/ 130–190/8–12 |

*processes e, f, g, h are not objects of the present invention
a: extruded ($T_{max}$ = 380° C.), press-quenched, naturally aged
b: extruded ($T_{max}$ = 380° C.), press-quenched, artificially aged (T = 130°–190° C., t = 8 hours–12 hours)
c: extruded ($T_{max}$ = 380° C.), press-quenched, cold worked, naturally aged
d: extruded ($T_{max}$ = 380° C.), press-quenched, cold worked, artificially aged (T = 130°–190° C., t = 8 hours–12 hours)
e: extruded ($T_{max}$ = 350° C.), quenched in salt bath, naturally aged
f: extruded ($T_{max}$ = 350° C.), quenched in salt bath, artificially aged (T = 130°–190° C., t = 8 hours–12 hours)
g: extruded ($T_{max}$ = 350° C.), quenched in salt bath, cold worked, naturally aged
h: extruded ($T_{max}$ = 350° C.), quenched in salt bath, cold worked, artificially aged (T = 130°–190° C., t = 8 hours–12 hours)
i: extruded ($T_{max}$ = 380° C.), press-quenched, tension straightened, naturally aged
j: extruded ($T_{max}$ = 380° C.), press-quenched, tension straightened, artificially aged (T = 130°–190° C., t = 8 hours–12 hours)
k: extruded ($T_{max}$ = 380° C.), press-quenched, cold worked, tension straightened, naturally aged
l: extruded ($T_{max}$ = 380° C.), press-quenched, cold worked, tension straightened, artificially aged (T = 130°–190° C., t = 8 hours–12 hours).

EXAMPLES

The invention will be disclosed further by means of actual examples.

Test alloys with compositions given in Table 2 were semicontinuously cast into bars with a diameter Φ288 mm, which were homogenization annealed for eight hours at a temperature of 490° C.±5° C., cooled to ambient temperature with a cooling rate of 230° C./hour, cut into billets turned to the diameter Φ275 mm, heated to the working temperature of 380° C. (processes a, b, c, d and i, j, k, l) or 350° C. (processes e, f, g, h), extruded into rods with the diameter Φ26.1 mm and thermally and thermomechanically worked according to the processes disclosed as processes a, b, c, d, e, f, g, h, i, j, k and l.

TABLE 2

Chemical compositions of test alloys (in wt. %)

| Mark | Si | Fe | Mn | Mg | Cu |
|---|---|---|---|---|---|
| K1 | 0.131 | 0.299 | 0.613 | 0.775 | 4.12 |
| K2 | 0.156 | 0.209 | 0.532 | 0.764 | 4.30 |
| K3 | 0.124 | 0.150 | 0.600 | 0.695 | 4.02 |
| K4 | 0.132 | 0.185 | 0.645 | 0.790 | 4.28 |
| K5 | 0.099 | 0.187 | 0.578 | 0.721 | 4.05 |
| K6 | 0.108 | 0.189 | 0.592 | 0.752 | 4.19 |
| K7 | 0.128 | 0.201 | 0.598 | 0.704 | 4.21 |
| K8 | 0.13 | 0.213 | 0.595 | 0.688 | 4.24 |
| K9 | 0.13 | 0.213 | 0.600 | 0.676 | 4.23 |

| Mark | Zn | Ti | Pb | Sn | Bi | Al |
|---|---|---|---|---|---|---|
| K1* | 0.0670 | 0.0109 | 0.9260 | 0.00 | 0.0214 | remainder |
| K2* | 0.0150 | 0.0110 | 0.0600 | 0.49 | 0.0380 | remainder |
| K3* | 0.0140 | 0.0050 | 0.0280 | 0.91 | 0.0380 | remainder |
| K4* | 0.0140 | 0.0050 | 0.0220 | 1.38 | 0.0180 | remainder |
| K5* | 0.0891 | 0.0088 | 0.0913 | 0.90 | 0.0634 | remainder |
| K6* | 0.0701 | 0.0099 | 0.0731 | 1.26 | 0.0461 | remainder |
| K7* | 0.0338 | 0.0122 | 0.0534 | 1.47 | 0.0343 | remainder |
| K8* | 0.0619 | 0.0137 | 0.054 | 1.63 | 0.0213 | remainder |
| K9* | 0.0649 | 0.0124 | 0.0567 | 1.75 | 0.0232 | remainder |

*0.0020–0.0070 wt. % Cr; 0.0003–0.0011 wt. % Zr, 0.0006–0.003 wt. % Ni, 0.0006–0.003 wt. % V

Mechanical properties of test alloys of the group AlCuMgSn and the standard alloy AlCuMgPb for various processes of thermal and thermomechanical treatments are shown in Tables 3 to 6.

TABLE 3

Tensile strength $R_m$ (N/mm$^2$) of test alloys depending upon tin content and kinds of manufacture*

| Process | K1** | K2 | K3 | K4 | K5 | K6 | K7 | K8 | K9 |
|---|---|---|---|---|---|---|---|---|---|
| % Sn | | 0.49 | 0.91 | 1.38 | 0.90 | 1.13 | 1.47 | 1.63 | 1.75 |
| a | 475 | 473 | 431 | 312 | 364 | 347 | 325 | 305 | 323 |
| b | 429 | 409 | 367 | 333 | 365 | 344 | 341 | 312 | 333 |
| c | 523 | 487 | 402 | 360 | 356 | 324 | 325 | 293 | 313 |
| d | 467 | 447 | 429 | 388 | 398 | 379 | 362 | 332 | 349 |
| e | 495 | | | | 428 | 395 | 370 | | |
| f | 463 | | | | 371 | 362 | 349 | | |
| g | 512 | | | | 419 | 382 | 350 | | |
| h | 466 | | | | 369 | 371 | 352 | | |
| i | 504 | 468 | 452 | 419 | 364 | 316 | 321 | 339 | 314 |
| j | 440 | 420 | 381 | 345 | 349 | 326 | 327 | 310 | 291 |
| k | 419 | 532 | 444 | | 364 | 334 | 351 | | |
| l | 470 | 449 | 434 | 398 | 377 | 354 | 363 | | |

TABLE 4

| Process | K1** | K2 | K3 | K4 | K5 | K6 | K7 | K8 | K9 |
|---|---|---|---|---|---|---|---|---|---|
| | Yield stress $R_{p0.2}$ ($N/mm^2$) of test alloys depending upon tin content and kinds of manufacture* | | | | | | | | |
| % Sn | | 0.49 | 0.91 | 1.38 | 0.90 | 1.13 | 1.47 | 1.63 | 1.75 |
| a | 349 | 336 | 313 | 164 | 330 | 311 | 300 | 281 | 298 |
| b | 361 | 323 | 307 | 235 | 268 | 238 | 235 | 211 | 231 |
| c | 513 | 464 | 384 | 354 | 263 | 244 | 276 | 213 | 233 |
| d | 443 | 412 | 400 | 357 | 338 | 320 | 306 | 294 | 286 |
| e | 394 | | | | 346 | 297 | 275 | | |
| f | 361 | | | | 287 | 274 | 271 | | |
| g | 440 | | | | 329 | 274 | 241 | | |
| h | 419 | | | | 287 | 308 | 283 | | |
| i | 417 | 377 | 368 | 336 | 275 | 230 | 231 | 256 | 243 |
| j | 396 | 374 | 326 | 289 | 264 | 234 | 242 | 249 | 226 |
| k | 336 | 520 | 419 | | 329 | 314 | 323 | | |
| l | 455 | 438 | 401 | 374 | 361 | 332 | 344 | | |

TABLE 5

| Process | K1** | K2 | K3 | K4 | K5 | K6 | K7 | K8 | K9 |
|---|---|---|---|---|---|---|---|---|---|
| | Hardness HB of test alloys depending upon tin content and kinds of manufacture* | | | | | | | | |
| % Sn | | 0.49 | 0.91 | 1.38 | 0.90 | 1.13 | 1.47 | 1.63 | 1.75 |
| a | 117 | 112 | 102 | 73 | 95 | 95 | 92 | 87 | 88 |
| b | 114 | 107 | 102 | 95 | 88 | 80 | 80 | 78 | 80 |
| c | 114 | 138 | 120 | 102 | 89 | 77 | 78 | 73 | 76 |
| d | 130 | 130 | 123 | 114 | 106 | 100 | 95 | 89 | 88 |
| e | 117 | | | | 104 | 102 | 99 | | |
| f | 112 | | | | 95 | 91 | 77 | | |
| g | 114 | | | | 89 | 87 | 85 | | |
| h | 104 | | | | 85 | 90 | 99 | | |
| i | 123 | 109 | 96 | 91 | 91 | 83 | 82 | 89 | 82 |
| j | 117 | 114 | 109 | 93 | 82 | 76 | 73 | 87 | 87 |
| k | 104 | 141 | 120 | | | | | | |
| l | 127 | 127 | 123 | 109 | | | | | |

TABLE 6

| Process | K1** | K2 | K3 | K4 | K5 | K6 | K7 | K8 | K9 |
|---|---|---|---|---|---|---|---|---|---|
| | Elongation at failure (%) of test alloys depending upon tin content and kinds of manufacture* | | | | | | | | |
| % Sn | | 0.49 | 0.91 | 1.38 | 0.90 | 1.13 | 1.47 | 1.63 | 1.75 |
| a | 12.5 | 11.0 | 10.5 | 11.0 | 7.0 | 6.5 | 6.0 | 7.5 | 8.0 |
| b | 9.0 | 8.5 | 9.0 | 10.0 | 12.5 | 13.0 | 13.0 | 12.5 | 12.0 |
| c | 5.5 | 6.0 | 4.5 | 5.0 | 10.5 | 9.5 | 10.5 | 12.0 | 10.0 |
| d | 7.0 | 7.5 | 7.0 | 7.0 | 9.5 | 9.5 | 9.5 | 10.0 | 10.0 |
| e | 9.0 | | | | 8.5 | 9.5 | 10.5 | | |
| f | 10.5 | | | | 10.5 | 10.5 | 10.5 | | |
| g | 9.5 | | | | 12.5 | 10.0 | 10.0 | | |
| h | 9.5 | | | | 10.0 | 9.0 | 9.0 | | |
| i | 10.0 | 11.0 | 10.0 | 11.5 | 9.0 | 9.0 | 9.0 | 9.5 | 9.5 |
| j | 9.0 | 10.0 | 9.0 | 10.0 | 10.5 | 10.5 | 10.5 | 9.5 | 9.5 |
| k | 11.5 | 6.0 | 8.0 | | 5.5 | 5.5 | 7.5 | | |
| l | 8 | 8.0 | 8.0 | 7.5 | 6.0 | 8.0 | 7.5 | | |

*Alloys K1, K2, K3, K4 have been aged for 8 hours at the temperature of 190° C. in processes b, d, f, h, j, l. Alloys K5, K6, K7, K8, K9 have been aged for 8 hours at the temperature of 160° C. in processes b, d, f, h, j, l. Other conditions of thermal treatment are given in Table 1.

**The alloy marked K1 is a reference alloy with 0.926 wt. % Pb.

In Table 7 there are disclosed forms and sizes of chips for a reference alloy AlCuMgPb and for a novel alloy AlCuMgSn, which is an object of the present invention, for various techniques of thermal and thermomechanical treatments at different cutting rates and materials for tools used.

TABLE 7

Classification of chips*** of the novel alloy of the type AlCuMgSn, which is an object of the present invention, and of the reference alloy AlCuMgPb at cutting rates 160 m/min (tool HSS) and 400 m/min (tool/carbide hard metal alloy) depending upon the kinds of thermal and thermomechanical treatment of alloys*

| | $v_c$ = 160 m/min (HSS) | | | | $v_c$ = 400 m/min (carbide hard metal alloy) | | | |
|---|---|---|---|---|---|---|---|---|
| Alloy | a | b | c | d | a | b | c | d |
| K1** | A | A | A | B | A | A | A | B |
| K2 | | C | C | | | B | B | |
| K3 | C/B | C | C | C | B | B | B | B |
| K4 | | A | A | | | A | A | |
| K5 | B | B | B | B | B | B | B | B |
| K6 | A | A | A | A | A | A | A | A |

*Note 1: Alloys K1, K2, K3, K4 were aged for 8 hours at the temperature of 190° C. in processes b, d. Alloys K5, K6 were aged for 8 hours at the temperature of 160° C. in processes b, d. Other conditions of thermal treatment are given in Table 1.
**Note 2: The alloy marked K1 is a reference alloy with 0.926 wt. % Pb.
***Note 3: Classification of chips according to quality comprises the size and the form of chips. Chips are classified into favorable (A), satisfactory (B) and unfavorable (C) groups.

Unfavorable chips: strips, bended chips, flat spirals
Satisfactory chips: slant spirals, long cylindrical spirals
Favorable chips: short cylindrical spirals, short spirals, spiral rolls, spiral lamellas, fine chips The reference alloy K1 has favorable chips (A). Alloys with less than 0.9 wt. % Sn have unfavorable (C) to satisfactory (B) chips in all phases depending upon the cutting rate. Alloys with more than 1.13 wt. % Sn have satisfactory (B) to favorable (A) chips depending upon the cutting rate. Alloys with more than 1.38 wt. % Sn have favorable chips (A) at all test conditions.

Another criterion of machinability is the roughness of the turned surface. At the same conditions of cutting and thermomechanical treatment there are no essential differences in surface roughness between the present alloy AlCuMgSn (over 1 wt. % Sn) and the reference standard alloy AlCuMgPb.

Alloys with the tin content in the range of 1.1 wt. % Sn to 1.5% Sn are preferable alloys since they possess an optimum combination of mechanical properties and machinability.

Microstructure of alloys: In the present cast alloys AlCuMgSn, tin in the form of spherical or polygonal inclusions is distributed on crystal grain boundaries. The frequency of tin inclusions increases with tin content. The size of these inclusions is from a few $\mu$m up to 10 $\mu$m. With intermetallic compounds on the basis of alloy elements and impurities, tin inclusions form nets around crystal grains. After processing by extrusion, these nets are crushed and inclusions on a tin basis are elongated in the deformation direction.

Inclusions on a tin basis are not homogeneous as to composition and distribution thereof. Besides tin, they also include alloy elements of aluminum, magnesium and copper, as well as elements of the impurities lead and bismuth. Their content in inclusions amounts to 1 to 20 wt. %.

The distribution of magnesium in the alloy is very important. Magnesium is bonded with tin according to binary phase diagram Mg—Sn into an intermetallic compound $Mg_2Sn$. The formation of this compound is undesired since bonded magnesium does not participate in the process of age hardening, the result being a lowering of strength properties. In the present alloy compositions, a smaller content of magnesium is present in the tin inclusions of alloys with up to 1.00 wt. % Sn. This magnesium content does not correspond to the stoichiometrical Mg:Sn ratio in the intermetallic compound $Mg_2Sn$.

Alloys produced according to processes of press-quenching show fibrous elongated crystal grains in the deformation direction after completed thermal and thermomechanical treatment.

Corrosion properties: Present test alloys of the type AlCuMgMn with Sn show similar or better resistance against stress corrosion in comparison with a standard alloy AlCuMgMn with Pb.

We claim:

1. A process for the manufacture of a free-cutting aluminum alloy comprising the steps of:

providing an aluminum alloy including 0.5 to 1.0 wt. % Mn, 0.4 to 1.8 wt. % Mg, 3.3 to 4.6 wt. % Cu, 1.1 to 1.9 wt. % Sn, 0 to 0.1 wt. % Cr, 0 to 0.2 wt. % Ti, 0 to 0.8 wt. % Si, 0 to 0.7 wt. % Fe, 0 to 0.8 wt. % Zn, 0 to 0.1 wt. % Pb, 0 to 0.1 wt. % Bi, up to 0.3 wt. % total of other elements, and balance essentially aluminum; and;

semicontinuous casting the alloy, followed by homogenization annealing, cooling from the homogenization annealing temperature, heating to a working temperature of extrusion, indirectly extruding at a maximum temperature of 380° C., followed by press-quenching and aging.

2. The process of claim 1 wherein the aging step is natural aging.

3. The process of claim 1 wherein the aging step is an artificial aging conducted at a temperature from 130° C. to 190° C. for a time period of from 8 to 12 hours.

4. The process of claim 1 including a cold working step conducted after the quenching step followed by natural aging.

5. The process of claim 1 including a cold working step conducted after the quenching step followed by artificial aging at a temperature from 130° C. to 190° C. for a time period of from 8 to 12 hours.

6. The process of claim 1 including a tension straightening step conducted after the quenching step followed by natural aging.

7. The process of claim 1 including a tension straightening step conducted after the quenching step followed by artificial aging conducted at a temperature from 130 to 190° C. for a time period of 8 to 12 hours.

8. A process for the manufacture of a free-cutting aluminum alloy comprising the steps of:

providing an aluminum alloy including 0.5 to 1.0 wt. % Mn, 0.4 to 1.8 wt. % Mg, 3.3 to 4.6 wt. % Cu, 1.1 to 1.9 wt. % Sn, 0 to 0.1 wt. % Cr, 0 to 0.2 wt. % Ti, 0 to 0.8 wt. % Si, 0 to 0.7 wt. % Fe, 0 to 0.8 wt. % Zn, 0 to 0.1 wt. % Pb, 0 to 0.1 wt. % Bi, up to 0.3 wt. % total of other elements, and balance essentially aluminum; and;

semicontinuous casting the alloy, followed by homogenization annealing, cooling from the homogenization annealing temperature, heating to a working temperature of extrusion, extruding at a maximum temperature of 380° C., followed by press-quenching, cold working, tension straigthening and aging.

9. The process of claim 8 wherein the aging step is natural aging.

10. The process of claim 8 wherein the aging step is artificial aging.

* * * * *

UNITED STATES PATENT AND TRADEMARK OFFICE

CERTIFICATE OF CORRECTION

PATENT NO. : 6,423,163 B2
DATED : July 23, 2002
INVENTOR(S) : Anton Smolej et al.

It is certified that error appears in the above-identified patent and that said Letters Patent is hereby corrected as shown below:

Column 14,
Line 33, "Bi, up to 0.3" should read -- Bi, 0 to 0.3 --.
Line 39, "indirectily" should read -- indirectly --.

Column 15,
Line 2, "Bi, up to 0.3" should read -- Bi, 0 to 0.3 --.

Signed and Sealed this

Twelfth Day of November, 2002

*Attest:*

*Attesting Officer*

JAMES E. ROGAN
*Director of the United States Patent and Trademark Office*